United States Patent [19]

Garavuso

[11] Patent Number: 4,526,359

[45] Date of Patent: Jul. 2, 1985

[54] DUAL JET BOTTOM VACUUM CORRUGATION FEEDER

[75] Inventor: Gerald M. Garavuso, Macedon, N.Y.

[73] Assignee: Xerox Corporation, Stamford, Conn.

[21] Appl. No.: 490,053

[22] Filed: Apr. 29, 1983

[51] Int. Cl.[3] ..... B65H 3/12

[52] U.S. Cl. ..... 271/94; 271/35; 271/98; 271/104

[58] Field of Search ..... 271/94, 96, 97, 98, 271/99, 104, 35

[56] References Cited

U.S. PATENT DOCUMENTS

| | | | |
|---|---|---|---|
| 1,207,365 | 12/1916 | Broadmeyer | 271/105 |
| 3,424,453 | 1/1969 | Halbert | 271/35 |
| 4,269,406 | 5/1981 | Hamlin | 271/108 |
| 4,275,877 | 6/1981 | Silverberg | 271/166 |
| 4,284,270 | 8/1981 | Silverberg | 271/166 |
| 4,305,576 | 12/1981 | Hamlin | 271/11 |
| 4,324,395 | 4/1982 | Silverberg | 271/98 |
| 4,336,928 | 6/1982 | Smith et al. | 271/3.1 |
| 4,427,192 | 1/1984 | Kushmaul | 271/98 X |

FOREIGN PATENT DOCUMENTS

| | | | |
|---|---|---|---|
| 2217755 | 6/1973 | Fed. Rep. of Germany | 271/105 |

*Primary Examiner*—Richard A. Schacher

*Attorney, Agent, or Firm*—William A. Henry, II

[57] ABSTRACT

An automatic document handler adapted to receive a stack of documents to be copied, feed the documents seriatim to the platen of a reproduction machine and return the documents to the stack. The combination of a vacuum-belt document corrugator/feed assembly and dual air knives is provided to assure positive feeding of each document to the platen without misfeeds or multifeeds.

6 Claims, 5 Drawing Figures

DUAL JET BOTTOM VACUUM CORRUGATION FEEDER

BACKGROUND OF THE INVENTION

In high speed xerographic copy reproduction machines wherein copies can be produced at a rate in excess of three thousand copies per hour, the need for a document handler to feed documents to the copy platen of the machine in a rapid, dependable matter was recognized to enable full utilization of the reproduction machines potential copy output. A number of document handlers are currently available to fill that need. These document handlers must operate flawlessly to virtually eliminate the risk of damaging the originals and generate minimum machine shutdowns due to uncorrectable misfeeds or document multifeeds. It is in the initial separation of the individual documents from the document stack where the greatest number of problems occur.

Since the documents must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also be utilized.

While the friction roll-retard systems are very positive, the action of the retard member, if it acts upon the printed face can cause smearing or partial erasure of the printed material on the document. With single sided documents, this does not present a problem as the separator can be designed so that the retard mechanism acts upon the underside of the document. However, with documents printed on both sides, there is no way to avoid the problem. Additionally, the reliable operation of friction retard feeders is highly dependent on the relative frictional properties of the paper being handled. This cannot be controlled in a document feeder.

Various other solutions to these problems have been advanced including U.S. Pat. No. 4,324,395 issued on Apr. 13, 1982 to Silverberg which is hereby incorporated by reference to the extent necessary to practice the present invention. In this patent, air knife levitation is used in conjunction with a vacuum-belt document corrugator/feed assembly to feed sheets from a tray. However, there still is the need for efficient high stack levitation in conjunction with an improved separation mechanism. A successful combination of these two functions has been difficult to achieve because levitation is best performed by a jet which has a high static pressure and low velocity while separation has required a high velocity at the transport belts and a severe stagnation pressure/velocity gradient to maintain separation. Other vacuum corrugation feeders include U.S. Pat. Nos. 4,269,406; 4,275,877; 4,284,270; 4,305,576 and 4,336,928. The present invention is an improvement over the Silverberg device and provides the solution for high stack feeding in the form of an improved vacuum feeder which consistently feeds high stacks of sheets in a positive yet gentle manner without misfeeds or multifeeds.

SUMMARY OF THE INVENTION

A sheet feeder for separating and feeding the bottom sheet in a sheet stack including a plurality of vacuum feed belts spaced from the bottom surface of the document stack, at least one of the belts being positioned below the stack support member(s) such that in operation, the bottom sheet in the stack is pulled into contact with the feed belts and corrugated. The corrugation stiffens and decurls the lead edge of the bottom sheet. The beam strength of the sheet resists following the corrugating action. Separate air jets are used for sheet levitation and sheet separation.

DESCRIPTION OF THE PREFERRED EMBODIMENT

Figure 1:
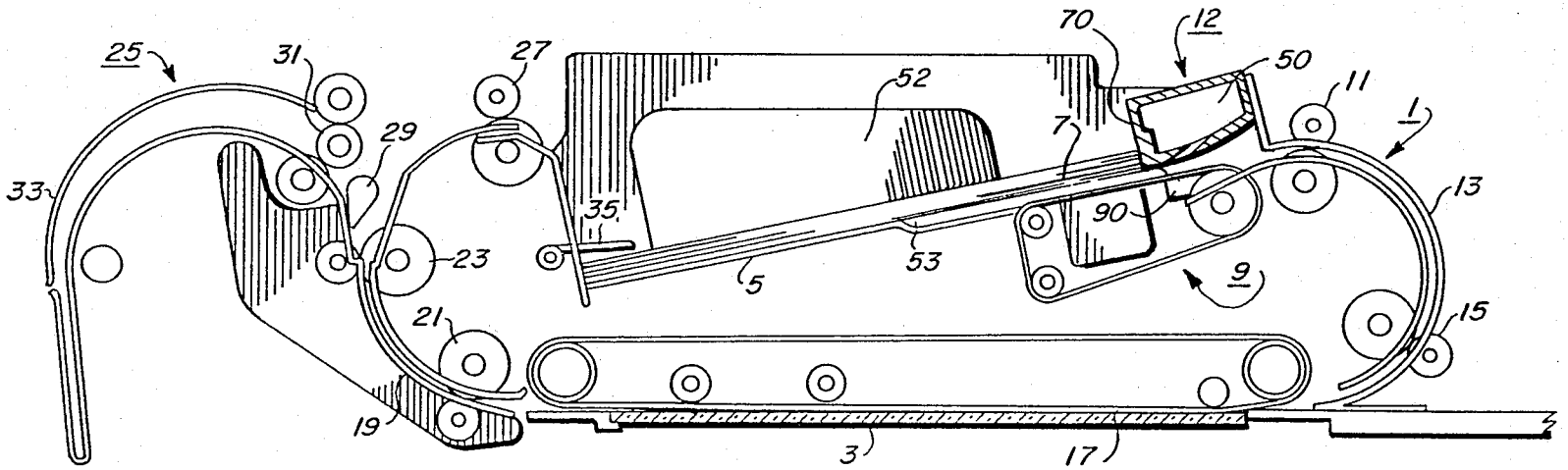
FIG. 1 is a cross-sectional view of an exemplary document handler employing the sheet separator-feeder of the present invention.

Referring to the drawings, there is illustrated an automatic document handler 1 for installation above the exposure platen 3 of a xerographic reproduction machine. The document handler is provided with a document tray 5 to be explained more fully hereinafter, adapted for supporting a stack of documents 7 face up. A vacuum belt-corrugating feeder mechanism 9 is located below the document tray for acquiring and corrugating the bottom document in the stack and forwarding the document to take away roll pair 11 after air knives 12 and 90 have had time to separate sheet one from the rest of the stack. The document is then fed by take-away roll pair 11 through document guide 13 to feed-roll pair 15 and under platen belt 17 onto the platen of the copy machine for reproduction. After exposure of the document, it is fed off the platen by belt 17 into guide 19 and feed-roll pairs 21 and 23 either to an inverter mechanism 25 or back to the document stack through the feed-roll pair 27. A diverter 29 is provided to divert the document either to the inverter or the feed-roll pair 27. The inverter comprises a three roll arrangement 31 and a closed inverter pocket 33. If the document is to be inverted it is fed through the lower two rolls of the three roll inverter into the pocket. When the trail edge of the document clears the nip of the lower two rolls in the three roll inverter, the stiffness of the sheet will cause the trail edge to straighten up into the nip of the upper two rolls of the inverter at which time it will be fed into roll pair 27 and back into the document peak. The inverter pocket illustrated is sized such that when the leading edge of the document contacts the end of the pocket, the document will buckle slightly within the upper portion of the pocket 33, the buckle thereby providing the required force to feed the trailing edge of the document into the upper roll pair of the inverter rolls for feeding the sheet toward rol pair 27. If desired, an open ended inverter pocket could be utilized having a feed roll pair associated therewith for feeding the document back into the upper roll pair in a positive manner rather than relying on the sheet buckle to feed the document thereto.

The document handler is also provided with a sheet separator finger 36 as is well known in the art to separate the documents to be fed from those documents returned to the document handler. Upon removal of the last document from beneath sheet separator finger 35, the finger 35 drops through a slot provided in the tray, suitable sensors are provided to sense that the last document in the set has been removed from the tray and the finger is then rotated in a clockwise direction to again come to rest on the top of the documents in the stack prior to subsequent recirculation of the document set.

Figure 2:
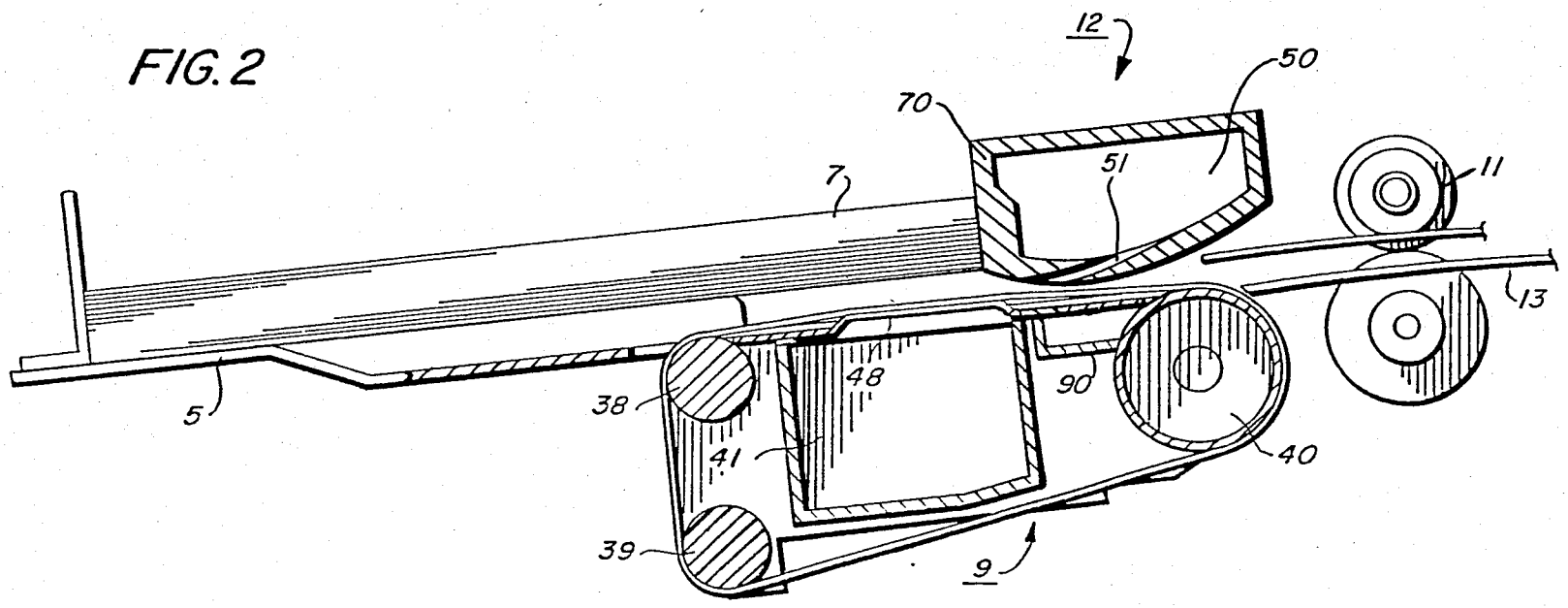
FIG. 2 is an enlarged, cross-sectional view of the separator-feeder portion of the document handler of FIG. 1.
Figure 3:
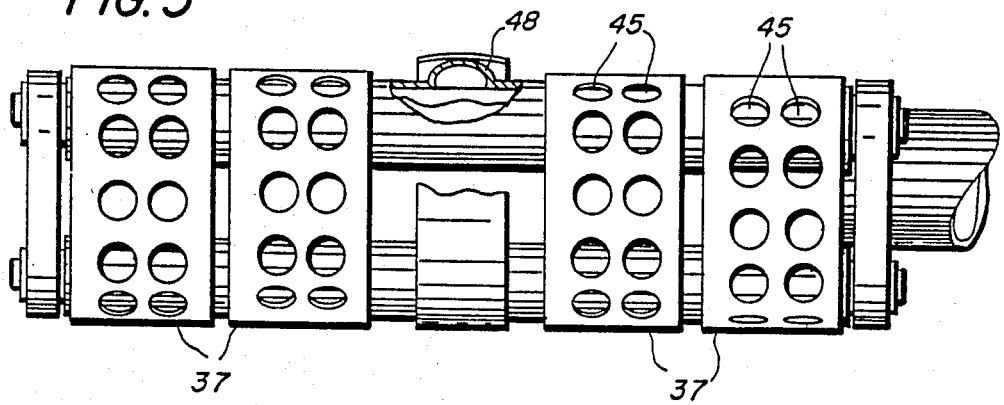
FIG. 3 is an end view, partially in section of the vacuum feed belts illustrated in FIG. 2.
Figure 5:
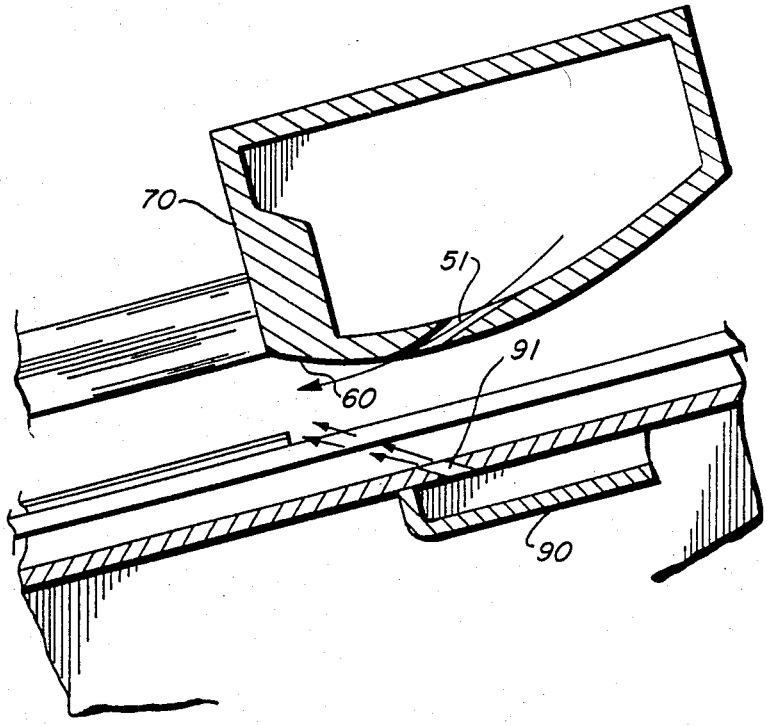
FIG. 5 is an exploded partial elevational view of the apparatus of the present invention.
Figure 4:
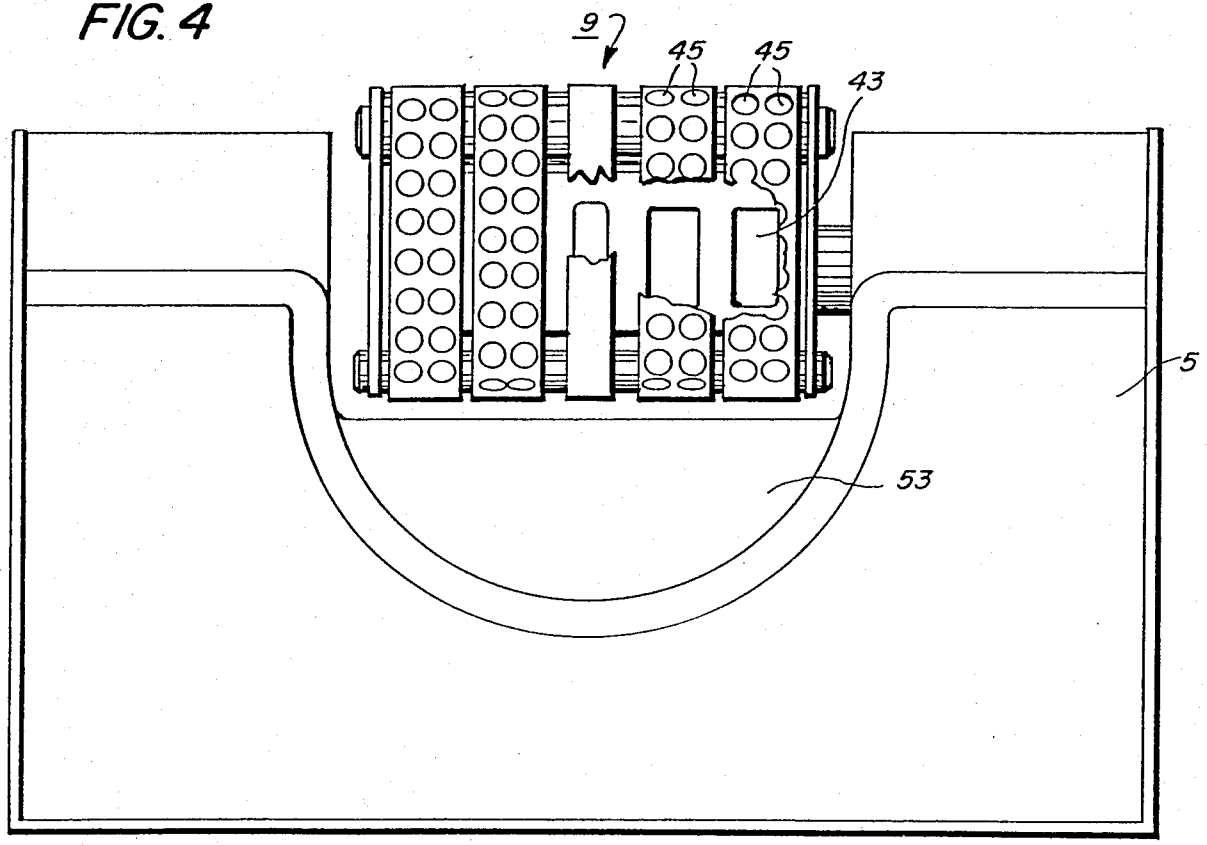
FIG. 4 is a top view of the document tray and feed belts of the document handler illustrated in FIG. 1.

Referring more particularly to FIGS. 2, 3 and 4 wherein the document separator-feeder is more clearly illustrated, there is disclosed a plurality of feed belts 37 supported for movement on feed belt rolls 38, 39 and 40. Spaced within the run of the belts 37 there is provided a vacuum plenum 41 having openings 43 therein adapted for cooperation with perforations 45 in the belts 37 to provide a vacuum for pulling the bottom documents in the document stack onto the belts 37. As can be seen from FIG. 3, the plenum is provided with a raised portion 48 beneath the center belt run so that upon capture of the bottom document in the stack against belts 37, a center corrugation will be produced in the bottom sheet. Note also that the belts are below the surrounding support surfaces. Thus, the document is corrugated into a double valley configuration. The flat surfaces of the vacuum belts on each side of the raised center belt generates a region of maximum stress in the document which varies with the document beam strength. In the unlikely event that more than one document is pulled down into contact with the feed belts, the beam strength of the second document resists the corrugating action, thus gaps are opened between sheets one and two which extend to their lead edges. These gaps and channels reduce the vacuum levels between sheets one and two due to porosity in sheet one and provide for entry of the separating air flow from the air knife 12. The air knife 12 comprised of pressurized air plenum 50 having an air jet opening 51 is provided to inject air between the document pulled down against the feed belt and the documents thereabove to provide an air cushion or bearing between the stack and the bottom document to minimize the force necessary for removing the bottom document from the stack. It can be understood that if two documents are pulled down toward the belts 37, since the top sheet would not be corrugated, the air knife would inject air into the space between the two documents and force the second document off from the raised belt back toward the document stack. Control of the height to which the stack is raised by the air pressure under sheet two is provided by openings such as cutaway 52 in the side wall (FIG. 1) and openings in the rear wall (not shown). These openings vent the air under sheet two when the stack is lifted to the height of the opening.

In order for the document feeder to be used without multifeeding with large document stacks in accordance with the present invention, air knife 12 is provided with a smooth curvilinear diffuser means or surface 60 angled upwardly toward the front of the sheet stack and works in condjunction with Coanda jet 12 and pocket seals in pocket 53 for levitation purposes. The diffuser provides a lowered velocity/high pressure profile to the Coanda jet. A front surface 70 of air knife 12 seals the air knife against the sheet stack. Even with this improved air knife configuration, multifeeds sometimes occurred. To break up double sheets separated from the stack by air knife 12 and insure single sheet feeding from large document stacks, a second Coanda jet 90 with a plurality of openings 91 is included in the present invention operating between belts 37. By placing the jet openings between the belts, the maximum velocity of the jet will occur at the stack edge, delivering an optimized separation action. Utilization of this structure enables high stack, high performance bottom feed vacuum corrugation feeding at a modest unit manufacturing cost over present feeders.

While perforated belts cooperating with openings in the vacuum plenum have been disclosed, it may be desirable to use "O" ring type feed belts with the vacuum plenum perforations located between the belt runs rather than beneath the belts. If "0" ring type feed belts are used however, the number of belts must be increased so that the spacing between belts is small enough to prevent the document being drawn down into contact with the vacuum plenum. Additionally the plenum surface should be raised up between the "0" ring belts in the region of the document lead edge. This raised portion is to minimize vacuum air flow under lead edge of the bottom sheet after it has been acquired. This helps prevent multifeeds when the lead edge of the second sheet is further forward than the lead edge of the bottom sheet.

By suitable valving and controls, it is desirable to provide a delay between the time the vacuum is applied to pull the document onto the belts and the start up of the feed belts to assure that the bottom document is captured on the belt before belt movement commences and to allow time for the air knife to separate sheet one from any sheets that were pulled down with it.

By reference to FIGS. 1, 2 and 4 it can be seen that the document tray 5 is provided with a depressed portion or pocket 53 having a generally parabolic outline behind the feed belt assembly. This pocket serves a number of purposes. First, space is provided for the forward portion of the bottom document to be pulled down onto the feed belt assembly providing for formation of the two valley corrugation previously mentioned. Secondly, the vacuum is applied over the area of the pocket with an air seal between the bottom document provided by the parabolic edges of the pocket. The air seal maximizes the vacuum force over the whole area of the pocket thus helping to pull the bottom document onto the feed belt assembly. A third function of the parabolic pocket is to provide for a high pressure seal between sheet one and the remainder of the stack. This high pressure seal is achieved by supporting a major portion of the stack weight in the edge regions of the pocket. The seal serves to reliably convert the velocity energy of the air knife flow into a lifting pressure over the pocket area.

To further increase the efficiency of the system, the stack tray is provided with a rearward tilt as seen in FIGS. 1 and 2. When floatation air is provided under the stack or between the first and second sheets, gravity will allow the sheets to settle or float back against the rear tray wall. Thus, the sheet being removed is pulled uphill while gravity helps hold the remainder of the sheets back, helping to prevent multifeeds.

With this disclosed engagement of pocket geometry, dual air knives and spaced, corrugating feed belt assembly, optimum document separation and feed for large document stacks can be obtained without the necessity for retard members or multiple sheet stops. Further the system is extremely gentle, and since the feed belts are not actuated until the document is firmly captured thereon, there is a minimal slippage between the document and the feed belts and therefore smear or document degradation is practically non-existent. It should be understood that the present separation system could be used for feeding substrates of any kind, such as, copy sheets, transparancies, etc.

While I have described a preferred embodiment of my invention, it should be understood that the invention may be otherwise embodied within the scope of the following claims.

What is claimed is:

1. A bottom sheet separator-feeder apparatus for separating and forwarding sheets in seriatim, comprising:

support means for supporting a stack of sheets;

first air knife means positioned adjacent the front of said stack of sheets;

diffusion means in communication with said air knife means to present a low velocity/high pressure profile to said stack of sheets to levitate the sheets above said support means;

vacuum means adapted to attract and corrugate the bottommost sheet from said stack of sheets;

a plurality of belt means entrained over said vacuum means for forwarding individual sheets from said stack of sheets for further processing; and second air knife means positioned between said plurality of belt means and adapted to apply positive pressure to the front of said stack of sheets to insure separation of the bottommost sheet from the next adjacent sheet.

2. The bottom sheet separator-feeder apparatus of claim 1, wherein said diffusion means comprises a smooth curvilinear surface angled upwardly along the bottom of said air knife means toward the front of said stack of sheets.

3. A bottom sheet separator-feeder for separating and forwarding sheets seriatim from the bottom of a stack of sheets to be fed, comprising a stack tray defining a surface for supporting a stack of sheets to be fed, vacuum feed means disposed in at least the front portion of said surface and adapted to pull the bottom sheet in the stack onto a surface of said vaccum feed means and feed the sheet from beneath the stack, and air knife means disposed adjacent the front of the tray and having at least one air jet opening to inject air between the bottom sheet in the stack and said tray and between the bottom sheet and the remainder of sheets in the stack, said air knife means including diffusion means, said diffusion means comprising a smooth and continuous curvilinear surface that is angled gradually upwardly beginning at said at least one air jet opening and ending adjacent the front of said tray in order to provide efficient levitation of a high stack of sheets by presenting a low velocity/-high pressure air jet profile to said stack of sheets.

4. The bottom sheet separator-feeder of claim 3, including air jet means positioned below the front edge of said stack of sheets and projecting upwardly at an angle such that the maximum velocity of air pressure from said air jet means will occur at the stack edge and thereby deliver optimized sheet separation action.

5. The bottom sheet separator-feeder of claim 3, wherein said vacuum means includes a plurality of vacuum feed belts entrained around a vacuum chamber.

6. The bottom sheet separator-feeder of claim 5, wherein said air jet means is positioned to inject air pressure between said vacuum feed belts against the front edge of the stack of sheets to insure against multifeeds.

* * * * *